US008469485B2

(12) United States Patent
Ramakrishnan et al.

(10) Patent No.: US 8,469,485 B2
(45) **Date of Patent: *Jun. 25, 2013**

(54) SYSTEM AND METHOD FOR EVALUATING AND CORRECTING IMAGE QUALITY IN AN IMAGE GENERATING DEVICE

(75) Inventors: Bhaskar T. Ramakrishnan, Wilsonville, OR (US); Andrew S. Yeh, Portland, OR (US); Mary Lynne Morrow, Molalla, OR (US); Ernest I. Esplin, Sheridan, OR (US); Pieter John Ganzer, Beaverton, OR (US); John Albert Wright, Molalla, OR (US); Brent Edward Fleming, Aloha, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/356,157

(22) Filed: Jan. 23, 2012

(65) Prior Publication Data

US 2012/0120144 A1 May 17, 2012

Related U.S. Application Data

(62) Division of application No. 12/401,263, filed on Mar. 10, 2009, now Pat. No. 8,132,885.

(51) Int. Cl.
*B41J 29/393* (2006.01)

(52) U.S. Cl.
USPC ..... 347/19; 347/5; 347/14

(58) Field of Classification Search
USPC ..... 347/5, 9, 14, 16, 19, 15
See application file for complete search history.

(56) References Cited

U.S. PATENT DOCUMENTS

| | | | |
|---|---|---|---|
| 6,736,478 | B2 | 5/2004 | Franzke et al. |
| 6,883,892 | B2 | 4/2005 | Sievert et al. |
| 7,073,883 | B2 | 7/2006 | Billow |
| 7,255,417 | B2 | 8/2007 | Yamazaki et al. |
| 7,267,419 | B2 | 9/2007 | Yamasaki |
| 7,287,824 | B2 | 10/2007 | Subirada et al. |
| 7,374,266 | B2 | 5/2008 | Walmsley et al. |
| 7,380,898 | B2 | 6/2008 | Plante et al. |
| 2003/0210926 | A1 | 11/2003 | Regimbal et al. |
| 2005/0083364 | A1 | 4/2005 | Billow |
| 2009/0027433 | A1 | 1/2009 | Van De Wynckel et al. |

*Primary Examiner* — Lam S Nguyen

(74) *Attorney, Agent, or Firm* — Maginot, Moore & Beck, LLP

(57) ABSTRACT

A system evaluates image quality in an image generating system. The system includes a test pattern generator configured to generate an image with an image generating system, an image capture device configured to generate a digital signal corresponding to the generated test pattern, an image evaluator configured to process the digital signal to detect and correct anomalies detected in the generated test pattern, a plurality of calibration tools, each calibration tool being comprised of at least one test pattern, at least one set of detection criteria, and at least one set of anomaly correction parameters, and a controller configured to select the calibration tools for operation of the test pattern generator and the image evaluator in accordance with a predetermined sequence that attenuates changes arising from application of correction parameters of one calibration tool upon a later selected calibration tool.

12 Claims, 13 Drawing Sheets

| PRECONDITIONS | LOGIC OPERAND | HEAD TO HEAD ALIGN _SWITCH | HEAD TO HEAD INTENSITY _SWITCH | Y DOT POSITION _SWITCH | TRC _SWITCH | DRUM RUNOUT _SWITCH | ENOUGH INK | ENOUGH PAPER | ENOUGH GOOD JETS |
|---|---|---|---|---|---|---|---|---|---|
| TOOL[HEAD TO HEAD ALIGN] | AND | | | | | | TRUE | | TRUE |
| TOOL[DRUM RUNOUT] | AND | ON | | | | | TRUE | | TRUE |
| TOOL[HEAD TO HEAD INTENSITY] | AND | ON | | | | ON | TRUE | TRUE | TRUE |
| TOOL[Y DOT POSITION] | AND | ON | ON | | | ON | TRUE | | TRUE |
| TOOL[TRC] | AND | ON | ON | ON | | ON | TRUE | TRUE | TRUE |

FIG. 7

| POST CONDITIONS | LOGIC OPERAND | HEAD TO HEAD ALIGN_SWITCH | HEAD TO HEAD INTENSITY_SWITCH | Y DOT POSITION_SWITCH | TRC_SWITCH | DRUM RUNOUT_SWITCH |
|---|---|---|---|---|---|---|
| TOOL[HEAD TO HEAD ALIGN] | AND | | | | | |
| TOOL[DRUM RUNOUT] | AND | OFF | | | | |
| TOOL[HEAD TO HEAD INTENSITY] | AND | OFF | | OFF | OFF | |
| TOOL[Y DOT POSITION] | AND | OFF | | | | |
| TOOL[TRC] | AND | OFF | | | | |

FIG. 8

SYSTEM AND METHOD FOR EVALUATING AND CORRECTING IMAGE QUALITY IN AN IMAGE GENERATING DEVICE

PRIORITY CLAIM

This application is a divisional application and claims priority to U.S. patent application having Ser. No. 12/401,263, which was filed on Mar. 10, 2009 and which will issue as U.S. Pat. No. 8,132,885 on Mar. 13, 2012.

TECHNICAL FIELD

This disclosure relates generally to devices that generate images, and more particularly, for imaging devices that eject ink from inkjets to form an image.

BACKGROUND

Devices that generate images are ubiquitous in today's technology. These devices include inkjet ejecting devices, toner imaging devices, textile printing devices, circuit board printing devices, medical printing devices, monitors, cellular telephones, and digital cameras, to name a few. Throughout the life cycle of these devices, the image generating ability of the device requires evaluation and, if the images contain detectable errors, correction. Before such an imaging device leaves a manufacturing facility, the device should be calibrated to ensure that images are generated by the device without perceptible faults. As the device is used, the device and its environment may experience temperature instabilities, which may cause components of the device to expand and shift in relation to one another. As the device is used, the intrinsic performance of the device may change reversibly or irreversibly. Consequently, the imaging generating ability of such a device requires evaluation and adjustment to compensate for the changes experienced by the device during its life cycle. Sometimes these evaluations and adjustments are made at time or usage intervals, while at other times the adjustments are made during service calls made by trained technicians.

Not all components or subsystems of an imaging device experience aging conditions to the same degree or with the same change. Consequently, some components or subsystems require adjustment to return the imaging capability of the device to an acceptable level before other components or subsystems require any adjustment at all. Moreover, adjustment in one component or subsystem may result in a change in another subsystem or component that may then require further adjustment in the altered subsystem or component. Consequently, the integration and interaction of components and subsystems in an imaging system need to consider during corrections to an imaging system to return the imaging capability of the system to acceptable norms.

SUMMARY

A system evaluates image quality in an image generating system in a manner that accounts for the interaction of the calibration tools used to evaluate and correct image quality in the image generating system. The system includes a test pattern generator configured to generate an image with an image generating system, an image capture device configured to generate a digital signal corresponding to the generated test pattern, an image evaluator configured to process the digital signal to detect and correct anomalies detected in the generated test pattern, a plurality of calibration tools, each calibration tool being comprised of at least one test pattern, at least one set of detection criteria, and at least one set of anomaly correction parameters, and a controller configured to select the calibration tools for operation of the test pattern generator and the image evaluator in accordance with a predetermined sequence that attenuates changes arising from application of correction parameters of one calibration tool upon a later selected calibration tool.

A method evaluates image quality in an image generating system in a manner that accounts for the interaction of the calibration tools used to evaluate and correct image quality in the image generating system. The method includes selecting a calibration tool from a plurality of calibration tools in accordance with a predetermined sequence that attenuates changes arising from application of one calibration tool upon a later selected calibration tool, generating at least one test pattern for the selected calibration tool with an image generating system, generating a digital signal corresponding to the generated test pattern, processing the digital signal to detect anomalies in the generated test pattern, and applying correction parameters associated with the selected calibration tool in response to the detection of anomalies in the generated test pattern.

BRIEF DESCRIPTION OF THE DRAWINGS

The foregoing aspects and other features of a system that evaluates image quality in an image generating system in a manner that accounts for the interaction of the calibration tools used to evaluate and correct image quality in the image generating system are explained in the following description, taken in connection with the accompanying drawings.

FIG. 7 is a table of preconditions for the machine states shown in FIG. 5.

FIG. 8 is a table of post-conditions for the machine states shown in FIG. 5.

DETAILED DESCRIPTION

Figure 1:
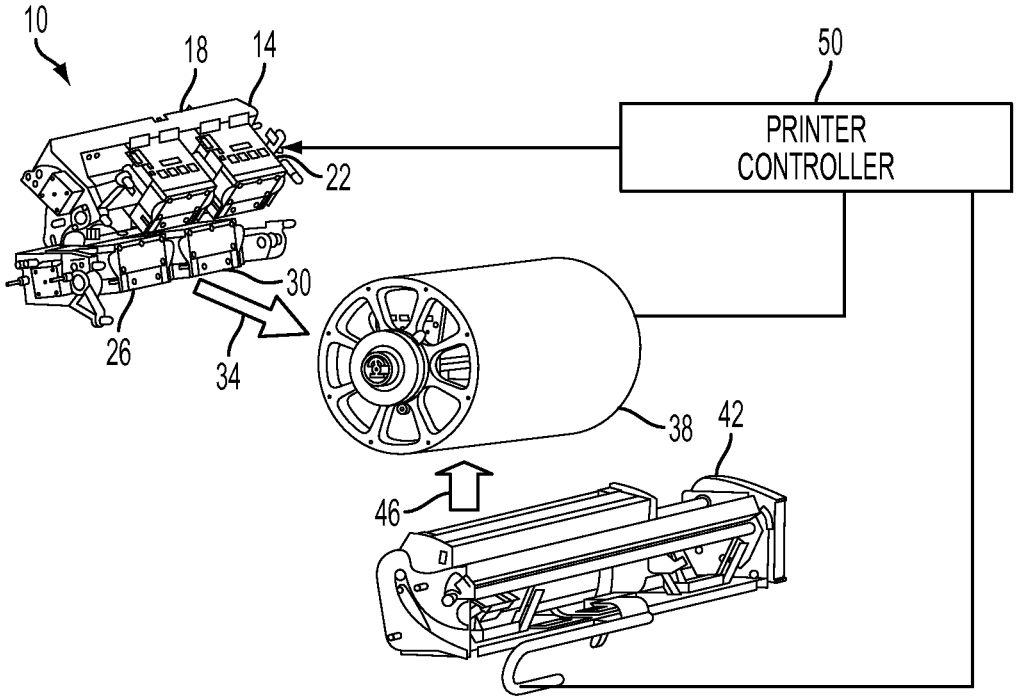
FIG. 1 is a block diagram of a printer depicting the components operated by a controller in accordance with a calibration tool to evaluate and correct, if necessary, an image generating component.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. Also, the description presented below is directed to a system for operating an inkjet printer using calibration tools in accordance with a predetermined sequence and a predetermined schedule. The reader should also appreciate that the principles set forth in this description are applicable to similar calibration tools operating a cellular telephone, digital projector, textile printing device, circuit board printing device, medical printing device, monitor, toner imaging system, or the like.

As shown in FIG. 1, a particular image generating system may be a printer. The printer 10 includes a printhead assembly 14, a rotating intermediate imaging member 38, an image capture device 42, such as a scanner, and a printer controller 50. The printhead assembly 14 includes four printheads 18, 22, 26, and 30. Typically, each of these printheads ejects ink, indicated by arrow 34, to form an image on the imaging member 38. The four printheads are arranged in a two by two matrix with the printheads in one row being staggered with reference to the printheads in the other row. Controlled firing of the inkjets in the printheads in synchronization with the rotation of the imaging member 38 enables the formation of single continuous horizontal bar across the length of the imaging member. The intermediate imaging member 38 may be a rotating drum, as shown in the figure, belt, or other substrate for receiving ink ejected from the printheads. Alternatively, the printheads may eject ink onto a substrate of media moving along a path adjacent to the printheads. The image capture device 42 includes a light source for illuminating the imaging member 38 and a set of light sensors, each of which generates an electrical signal having an amplitude corresponding to the intensity of the reflected light received by a sensor.

The printer controller 50 includes memory storage for data and programmed instructions. The controller may be implemented with general or specialized programmable processors that execute programmed instructions. The instructions and data required to perform the programmed functions may be stored in memory associated with the processors or controllers. The processors, their memories, and interface circuitry configure the controllers to perform the functions, such as the calibration tools and the scheduling of the selection of the tools, as described more fully below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The controller 50 in FIG. 1 is coupled to the printhead assembly 14, the imaging member 38, and the image capture device 42 to synchronize the operation of these subsystems. To generate an image, the controller renders a digital image in a memory and generates inkjet firing signals from the digital image. The firing signals are delivered to the printheads in the assembly 14 to cause the inkjets to eject ink selectively. The controller is also coupled to the imaging member 38 to control the rate and direction of rotation of the imaging member 38. Controller 50 also generates signals to activate the image capture device for illumination of the imaging member 38 and generation of a digital signal that corresponds to the image on the member 38. Sometimes this digital signal is referred to as an image on the drum or IOD. This digital signal is received by the controller 50 for storage and processing.

To evaluate the quality of the images being generated, the controller 50 may include a plurality of calibration tools. In general, these calibration tools are executed by the controller 50 to generate images, called test patterns, on the imaging member 38, and then process the digital signal generated by the image capture device 42 from the image on the drum to detect anomalies in the image generating system. The calibration tools then enable the controller 50 to adjust one or more parameters of the image generating system to address the detected anomaly. In one embodiment, a plurality of calibration tools provided for a controller include a printhead-to-printhead alignment calibration tool, a printhead-to-printhead intensity calibration tool, a missing inkjet calibration tool, a tonal reproduction curve (TRC) calibration tool, a Y dot position calibration tool, and a drum runout calibration tool. One implementation of these tools is now discussed with reference to FIG. 2A through FIG. 2E.

Figure 2A:
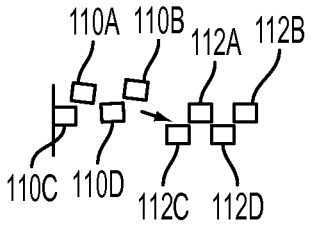
FIG. 2A is an illustration of the result of operating a printer with a head alignment calibration tool.

FIG. 2A to FIG. 2E depict before and after results of operating a printer with a particular type of calibration tool. In each figure, four printheads are arranged in two rows of two printheads each that are separated by a distance that corresponds to a printhead width as illustrated above in printhead assembly 14. In FIG. 2A, one or more of the printheads have moved from their optimally aligned positions. The result of having all four printheads eject ink from all of the inkjets in each printhead yields four blocks of solid color 110A, 110B, 110C, and 110D that are misaligned relative to one another. This misalignment may be caused by an uneven thermal expansion of the printhead chassis in the assembly 14. Consequently, the end jets of adjacent printheads may not be positioned to allow good print quality. Additionally, the displacement of the printheads may not stabilize until thermal equilibrium is achieved in the imaging system. Moreover, the displacement envelope often decays exponentially with time. Therefore, selection of the head alignment calibration tool may occur more frequently at system initiation when the system is cooler and further from equilibrium than later when the system is warmer and closer to equilibrium. Alternatively, the system temperature may oscillate around the equilibrium temperature with a displacement envelope that decays with time. The selection of the head alignment calibration tool occur more frequently when the oscillations are larger and less frequently when the oscillations are smaller. Operation of the printer components in accordance with the printhead-to-printhead alignment calibration tool enables the controller to obtain a digital signal corresponding to a test pattern printed on the member 38 and calculate a positional error. This error is plotted with reference to a system thermal expansion time curve. A predetermined positional error limit and the position error curve are used by the alignment calibration tool to measure the positional error. If the error is greater than the measurement noise, anomaly correction parameters are used to adjust the printhead positions and reduce the error to an acceptable range. After operation of a head alignment calibration tool, the four blocks of solid color 112A, 112B, 112C, and 112D are aligned with one another.

Figure 2B:
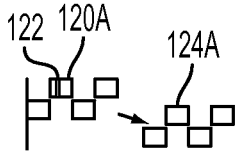
FIG. 2B is an illustration of the result of operating a printer with a missing jet calibration tool.

In FIG. 2B, block 120A has a defective inkjet. Consequently, the printhead produces a test image with a nonprinted vertical line 122 corresponding to the position of the defective inkjet in the block. Defective inkjets may be caused by, for example, paper dust, air bubbles in the ink, ink on the printhead faceplate, or the like. Periodic checks during the operational life of the printer are typically adequate to detect defective inkjets. In one embodiment, the periodicity of the inkjet calibration tool may correspond to the number of pages printed since the last operation of the missing inkjet calibration tool. Operation of a missing jet calibration tool detects the missing inkjet and operates to correct the missing inkjet or to adjust operation of other neighboring inkjets to compensate for the missing inkjet as shown in block 124A.

Figure 2C:
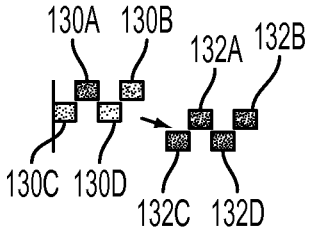
FIG. 2C is an illustration of the result of operating a printer with a printhead-to-printhead intensity calibration tool.

In FIG. 2C, solid block 130A has a different intensity than blocks 130B, 130C, and 130D. The differences arise from factors, such as decreasing piezoelectric actuator efficiency, that cause less ink to be ejected for a given amount of energy in a firing signal. As actuators in different printheads age at different rates, the differences in the intensities of solid fill blocks generated by the printheads may be detected in the digital signals generated by the image capture device that correspond to the different blocks. The frequency for selecting the printhead-to-printhead intensity calibration tool may be based on an empirical determination of actuator efficiency loss over time. After a printhead-to-printhead intensity calibration tool is used to operate the printer, the distribution of the drop masses for ink drops ejected by one printhead in response to firing signals in a particular range of amplitudes is approximately the same as the distribution of the drop masses for ink drops ejected by another one of the printheads in response to firing signal in a corresponding range of amplitudes. Consequently, boundaries between a line of drops ejected by one printhead and another line of drops ejected by another printhead are not detectable to the human eye.

The schedule for the printhead-to-printhead intensity calibration tool may be adjusted during the life of the imaging system in one embodiment. In this embodiment, the amount of adjustment to restore uniformity between the printheads may be compared to predetermined thresholds to determine whether the amount of correction is less than or greater than a correction amount expected at a particular time in the life of the image generating system. If the correction is greater than expected, the frequency schedule may be adjusted to select the printhead-to-printhead intensity calibration tool more often. If the correction is less than expected, the frequency schedule may be adjusted to select the tool less frequently than originally scheduled. Alternatively, multiple intensity tool schedules may be stored in the system and one of the schedules selected in response to an event or in response to a manual selection of the schedule. For example, replacement of a printhead with a new printhead may be a result that causes another schedule to be selected for performance of the printhead-to-printhead intensity calibration tool.

Although not depicted in the figures, the TRC calibration tool is selected to address another issue arising from the changing piezoelectric actuator efficiency. TRCs are data stored within a printer to dither image data to compensate for non-uniformity between inkjets or printheads. Inkjet TRCs minimize intensity differences for lengths corresponding to jet lengths at one or more dither levels. Corrections to a TRC may be performed in response to manual selection of the calibration tool or in accordance with a predetermined schedule.

Figure 2D:
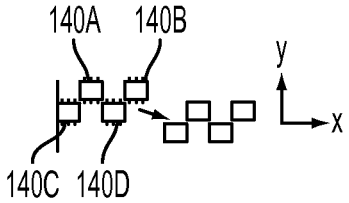
FIG. 2D is an illustration of the result of operating a printer with a Y dot position calibration tool.

Continuing with the discussion of the calibration tools, the solid blocks 140A, 140B, 140C, and 140D in FIG. 2D are depicted with ragged boundaries on the upper and lower edges of the blocks. As shown in the figure, the Y axis corresponds with the rotation of the imaging member, while the X axis corresponds with the length of the imaging member. These directions are sometimes referenced as the process and cross-process directions, respectively. Alterations in the position where an inkjet deposits an ink drop may arise from the changes in the distance between a printhead and an imaging member, the velocity of the ejected ink drops, or the direction of the ejected ink drops, for example. The velocity of an ink drop is influenced by the physical parameters of the ink, such as the viscosity, the surface tension, the temperature of the ink, the geometry of the inkjet ejecting the drop, and the voltage waveform applied to the piezoelectric actuator for the inkjet. As already noted, the piezoelectric materials and other inkjet structures vary over the life of the printer so the velocity of the ejected ink drops also vary. Also, adjustments made to the mass of the ink drops ejected, such as may occur in response to corrections made by the printhead-to-printhead intensity calibration tool, cause positional variations in the drops ejected by an inkjet. The Y dot position calibration tool operates the printhead assembly to generate a test pattern image on the imaging member and the corresponding digital signal generated by the image capture device is used by the controller to measure positional errors for inkjets. One or more of the parameters affecting ink drop mass and/or velocity may then be altered to attenuate the detected positional errors. This calibration tool may be selected for operation of the printer on a manual or predetermined schedule basis.

Figure 2E:
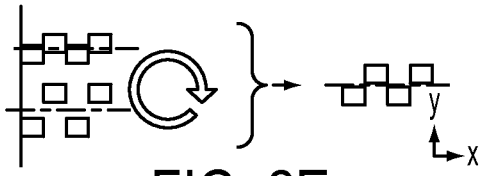
FIG. 2E is an illustration of the result of operating a printer with a drum runout calibration tool.

As shown in FIG. 2E, the relative position of the heads may change over time and result in image position on the imaging member. These position changes relate to both static and dynamic runout errors. Geometric changes typically correspond to static errors, while velocity changes in member rotation contribute to dynamic errors. Both types of runout errors produce positional errors in the Y direction. Selection of the drum runout calibration tool and operation of the printer with reference to that tool enables the controller to detect Y positional errors from the digital signal corresponding to a test pattern generated by the calibration tool. Anomaly parameters may then be applied to the control of the drum rotation to compensate for the detected runout error.

Figure 3:
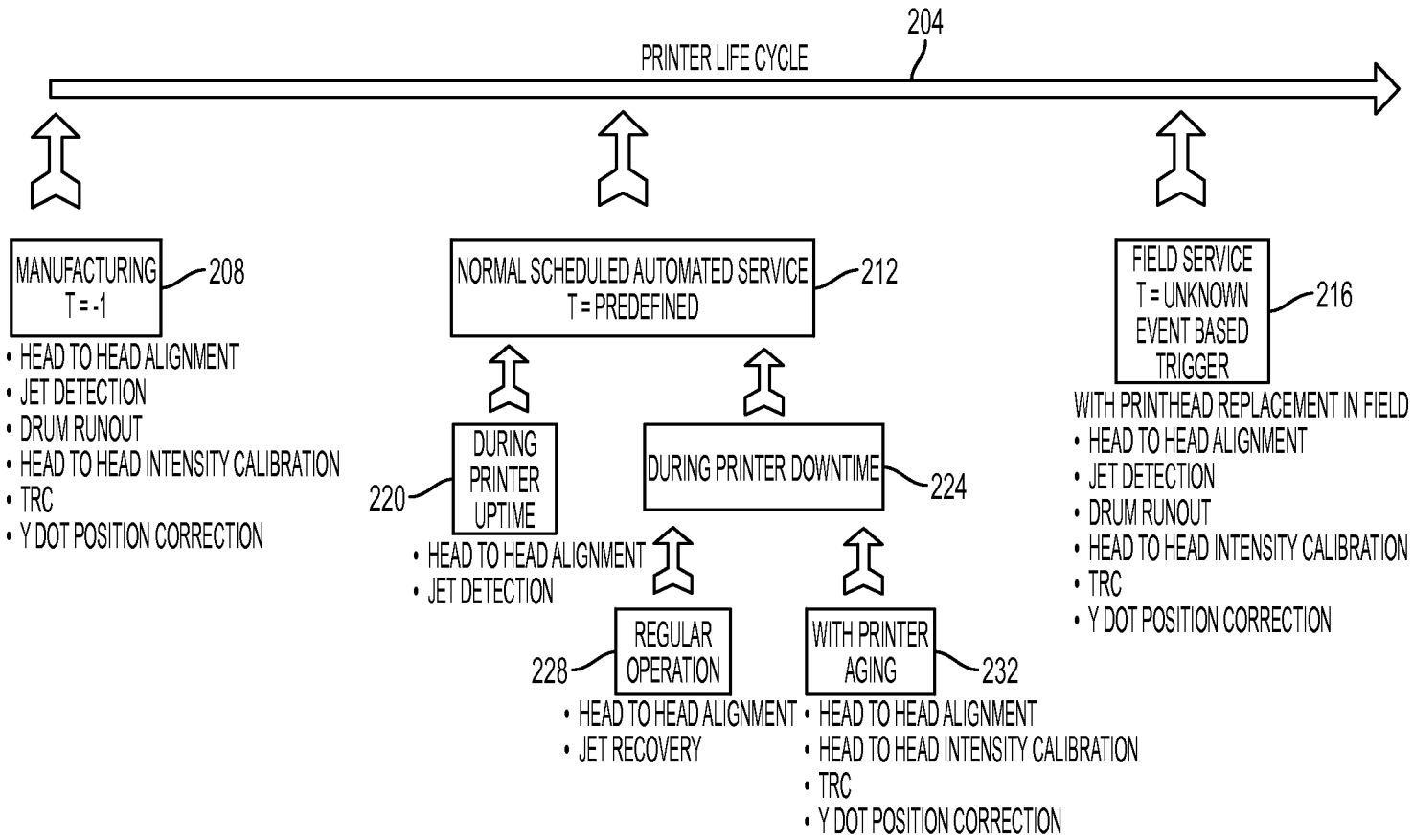
FIG. 3 is a time line of a printer life cycle and the various types of calibration tools used during the printer life cycle.

FIG. 3 illustrates the use of calibration tools at three junctures in the life of an image generating system. The life of the system is represented by the arrow 204. The three junctures are during manufacture of the system (block 208), during automated maintenance events (block 212), and during field service events in which a printhead is replaced (block 216). During the initial system calibration that prepares the system for commencement of its operational life (block 208), all of the calibration tools discussed above are used to operate the system and configure the system components within acceptable norms. The automated maintenance events are conducted in accordance with a predetermined schedule. The events may occur during times when the system is actively involved in producing images (block 220) and when the system is relatively idle (block 224). During active production, only the printhead-to-printhead alignment and inkjet detection calibration tools are likely to be selected for system operation. During idle times, those same tools are likely to be selected (block 228), while after some predetermined aging in which one or more system components, such as the piezoelectric actuators, may have changed (block 232), the Y dot position, TRC, and printhead-to-printhead intensity calibration tools are also likely to be selected. When a maintenance field service event includes a printhead replacement (block 216), all of the calibration tools are selected for operation of the system to return all components to the acceptable norms used for the initial release of the system.

Figure 4:
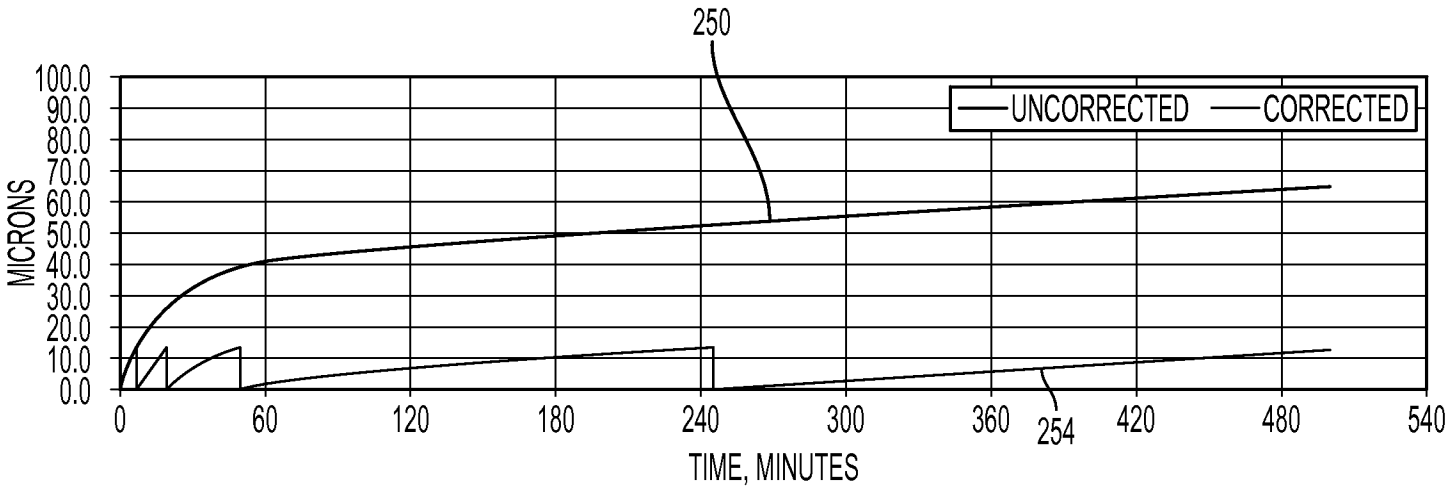
FIG. 4 is a graph of predicted corrected and uncorrected head misalignment in a printer.

The printhead alignment tool and the missing jet tool are selected more frequently because alignment errors and defective jets are more likely to occur than errors arising from aging of the system. The predetermined times for the alignment tool selection and operation may be set in accordance with a thermal expansion equation. One example of an equation predicting alignment error is: $E(t)=A*(1-\exp(-t/B))+R_t-E_a$, where A is the exponential asymptote, B is the exponential half-life, R is the steady-state misalignment rate, and $E_a$ is the value of $(A*(1-\exp(-t/B))+R_t)$ just prior to completing the most recent realignment. In one embodiment, A is 40 microns, B is 20 minutes, and R is 0.05 microns/minute. A curve 250 showing the uncorrected error prediction is depicted in FIG. 4 as well as a corrected misalignment curve 254. Other equations may be used that are derived theoretically or empirically from different embodiments to predict alignment error. The events leading to missing jets, such as paper dust, air bubbles, and the like, may also be modeled by an equation. Subsequently, the rate of operation of a tool that combines the printhead alignment tool and the missing jet tool may be determined from the preceding equations. The missing jet tool is also performed more frequently than the tools correcting errors arising from system aging.

Figure 5:
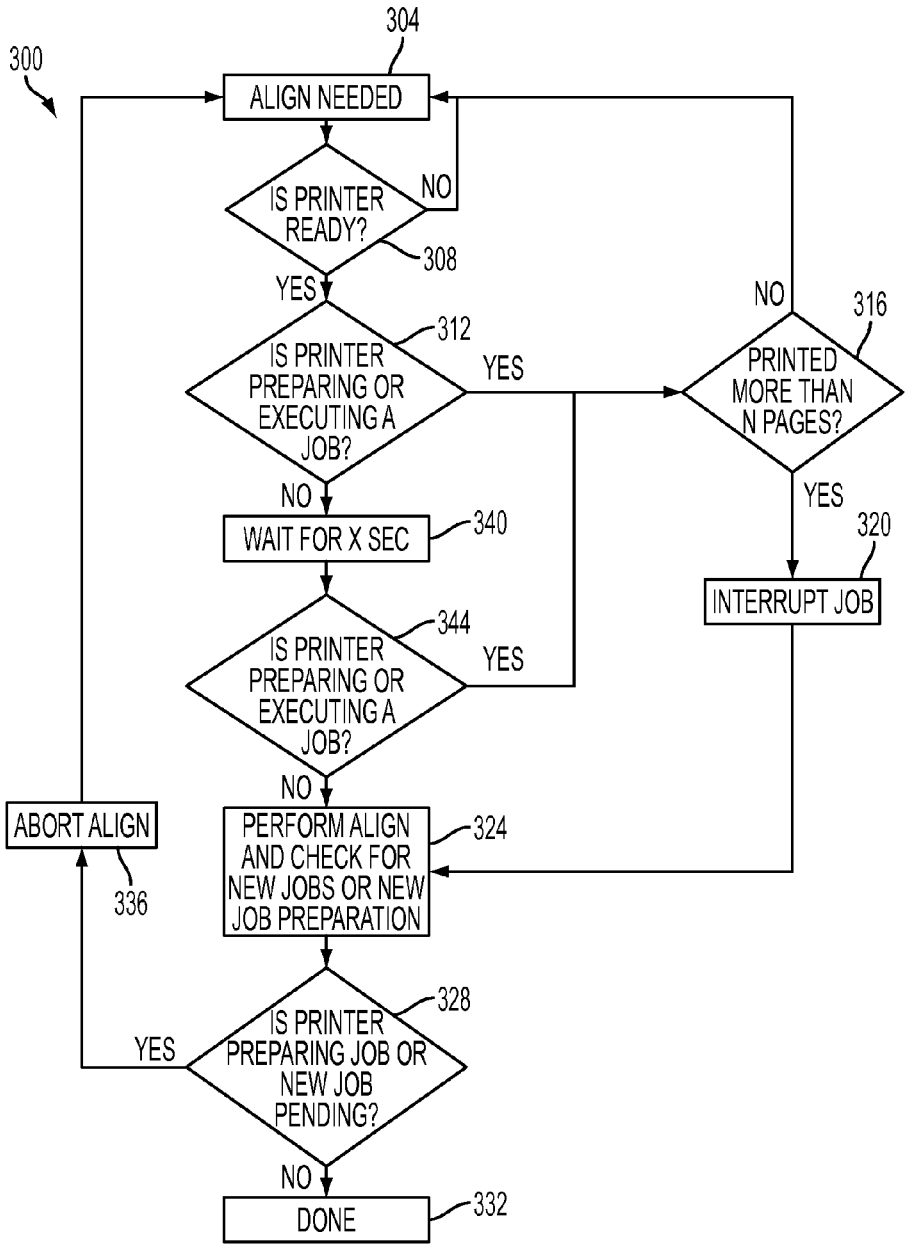
FIG. 5 is a flow diagram of a process for scheduling head alignment calibration tool operation with reference to printer workload.

To prevent the more frequently selected alignment tool and missing jet tool from causing customer inconvenience while the customer waits for tool operation to finish, a method for minimizing workload interruption has been developed. An implementation of this method is shown in FIG. 5. In this method 300, a scheduled time for alignment tool selection has been reached (block 304). The method determines whether the system is ready (block 308) and, if the system is not ready, the method loops as it waits for the system to be ready. Once the system is ready, the process determines whether the system is preparing or executing a job (block 312). If it is, a check is made to determine whether the number of pages printed exceeds a predetermined threshold (block 316). If the limit has not been exceeded, the process loops until the page limit is exceeded or no job is being prepared or executed. If the limit is exceeded, the job is interrupted (block 320), the alignment tool is used to operate the printer for detection and correction of any alignment errors (block 324), and then the process determines whether another job is being prepared or is pending (block 328). If no job is in process, the process is finished (block 332). Otherwise, the alignment tool selection is aborted and the process waits for the next scheduled alignment tool selection (block 304).

If no job was being prepared or executed, the process waits for a predetermined time period (block 340) and then determines whether a job is being prepared or executed (block 344). If a job is being prepared or executed, a check is made to determine whether the number of pages printed exceeds a predetermined threshold (block 316). If the limit has not been exceeded, the process loops until the page limit is exceeded or no job is being prepared or executed. If the limit is exceeded, the job is interrupted (block 320), the alignment tool is used to operate the printer for detection and correction of any alignment errors (block 324), and then the process determines whether another job is being prepared or is pending (block 328). If no job is in process, the process is finished (block 332). Otherwise, the alignment tool selection is aborted and the process waits for the next scheduled alignment tool selection (block 304).

If no job is being prepared or executed after the time period has expired (block 344), the alignment tool is used to operate the printer for detection and correction of any alignment errors (block 324), and then the process determines whether another job is being prepared or is pending (block 328). If no job is in process, the process is finished (block 332). Otherwise, the alignment tool selection is aborted and the process waits for the next scheduled alignment tool selection (block 304). Thus, the process of FIG. 5 enables the printer to continue preparing or executing a job until a page limit is exceeded. At that time, the alignment tool is used to detect and correct alignment errors, if detected.

Figure 6:
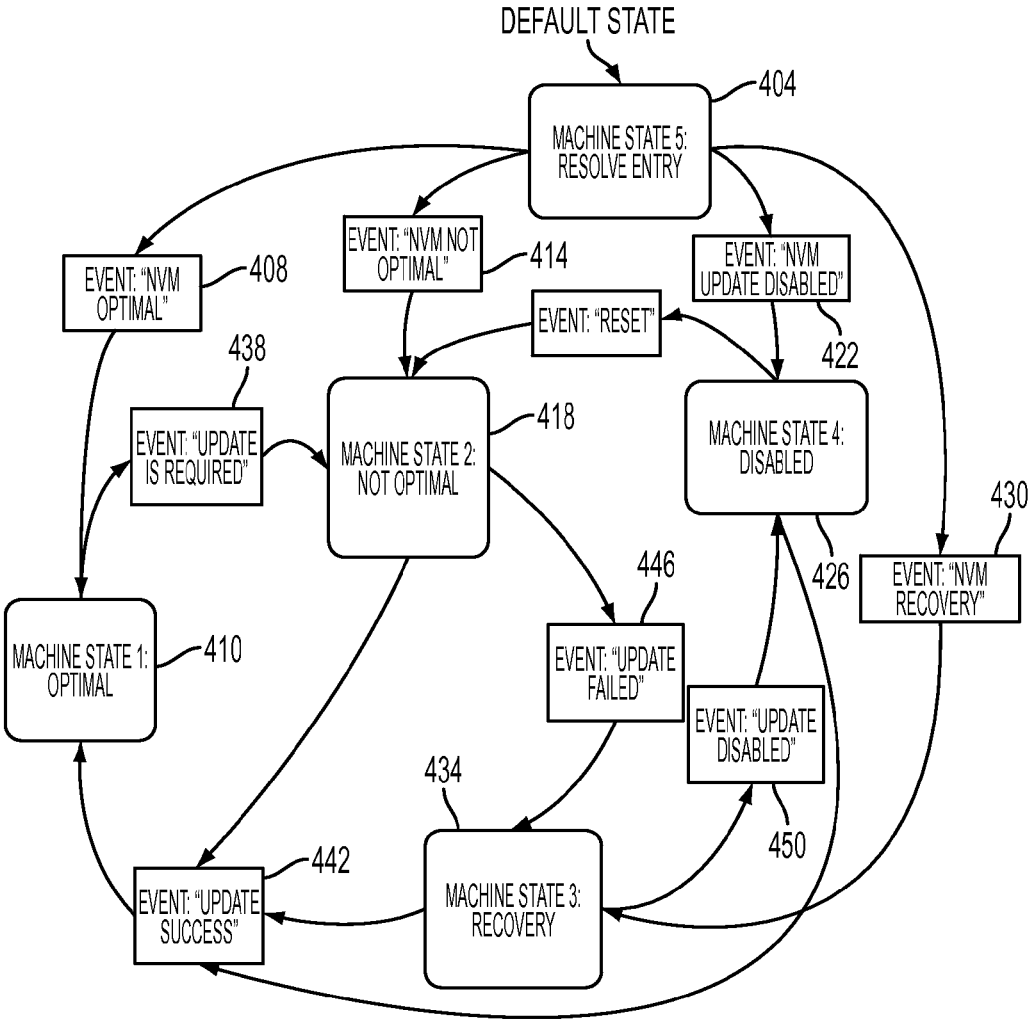
FIG. 6 is a state diagram used to represent a calibration tool status in an image generating system.

The condition of a calibration tool may be described with reference to a state diagram, such as the one shown in FIG. 6. As described in more detail below, a status condition of a calibration tool may be stored in non-volatile memory (NVM). This condition value may be displayed for operator or service personnel. In the state diagram 400) of FIG. 6, the value of the condition is used to resolve the machine state (block 404). The value of the condition determines the transition to the next machine state. If the condition is optimal (block 408), the machine state transitions to optimal (block 410). If the condition is not optimal (block 414), the machine state transitions to not optimal (block 418). If the condition is update disabled (block 422), the machine state transitions to disabled (block 426). If the condition is recovery (block 430), the machine state transitions to a recovery state (block 434). Once in the optimal machine state (block 410), an update needed event (block 438) causes a transition to the not optimal machine state (block 418). Upon either an update successful event (block 442) or an update failed event (block 446), the machine state transitions to the optimal machine state (block 410) or to the recovery machine state (block 434). An update successful event (block 442) enables the machine state to return to the optimal machine state (block 410), while an update disabled event (block 450) causes the disabled machine state to be entered (block 426). Only upon a reset event (block 454), does the tool transition from the disabled state (block 426) to the not optimal state (block 418). From there, the tool attempts to update the system to either return to the optimal state (block 410) or eventually return to the disabled state (block 426). In one embodiment, the tool may remain in the recovery state until idle time is detected because the update event for the tool may be time intensive.

In one embodiment, the printhead-to-printhead alignment tool is configured to also operate the printer to detect and correct missing jets as well. Thus, this embodiment operates with a plurality of five calibration tools. Because the sequence in which the tools are selected and used to operate the printer impacts the components adjusted by another calibration tool, the tools are selected with reference to a predetermined sequence along with certain preconditions and post-conditions. In one embodiment, the sequence is (1) printhead-to-printhead alignment/missing jet detection tool, (2) drum runout tool, (3) printhead-to-printhead intensity tool, (4) Y dot position tool, and (5) TRC tool. The preconditions are used to determine whether a tool may be selected and used to operate the printer, while post-conditions are used to determine what status condition to store in non-volatile memory for the tool. Exemplary preconditions and post-conditions for the five calibration tools are shown in FIG. 7 and FIG. 8.

Figure 9:
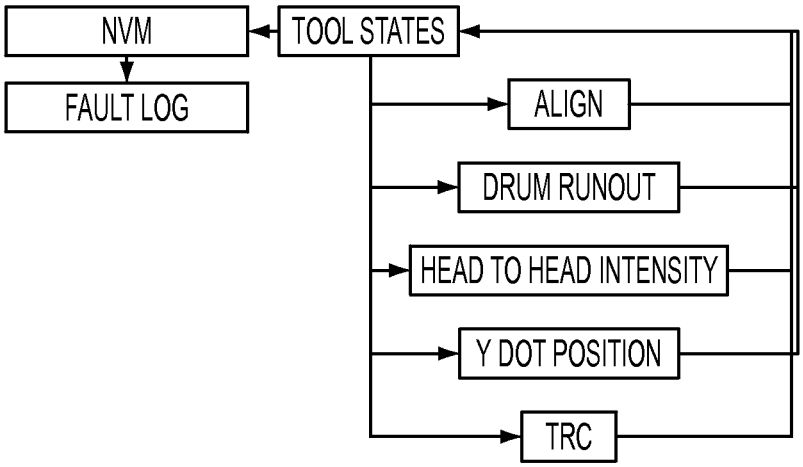
FIG. 9 is a predetermined sequence of calibration tool operation in an image generating system.

As noted above, the controller stores the state of each tool in a non-volatile memory. An error code corresponding to the tool states is generated and displayed on a user interface screen. This process is represented in FIG. 9. If image quality degrades to an unacceptable level, the controller evaluates the error code and then the tool states in the sequence order. In general, any tool having a status of not optimal or recovery, the corresponding tool is selected and used to operate the system. Once the tool status is upgraded to optimal, the next tool status is checked. The process is repeated until all of the tools are at optimal status.

Figure 10:
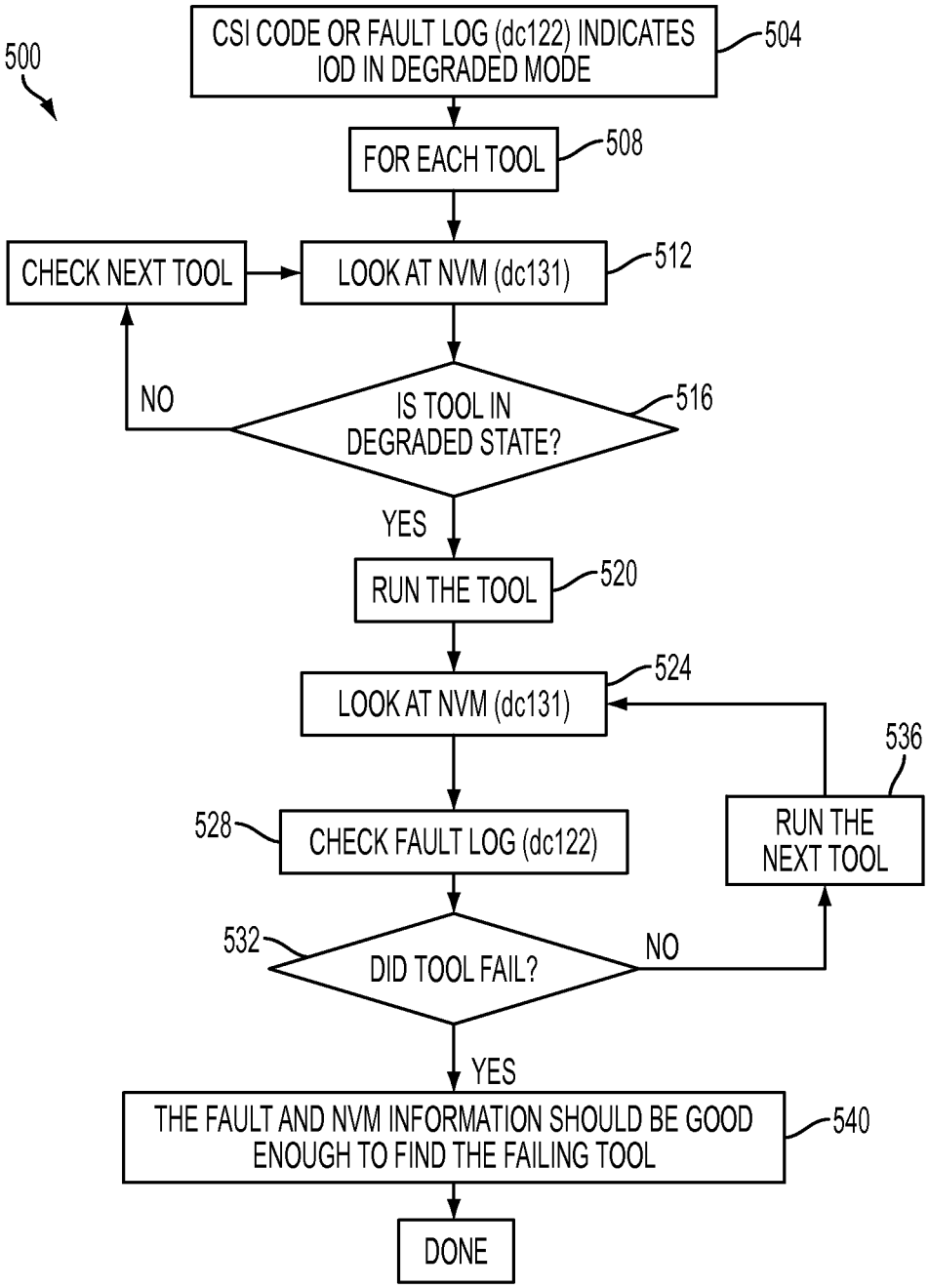
FIG. 10 is a flow diagram operating a printer with reference to the predetermined sequence of calibration tools shown in FIG. 8.
Figure 11:
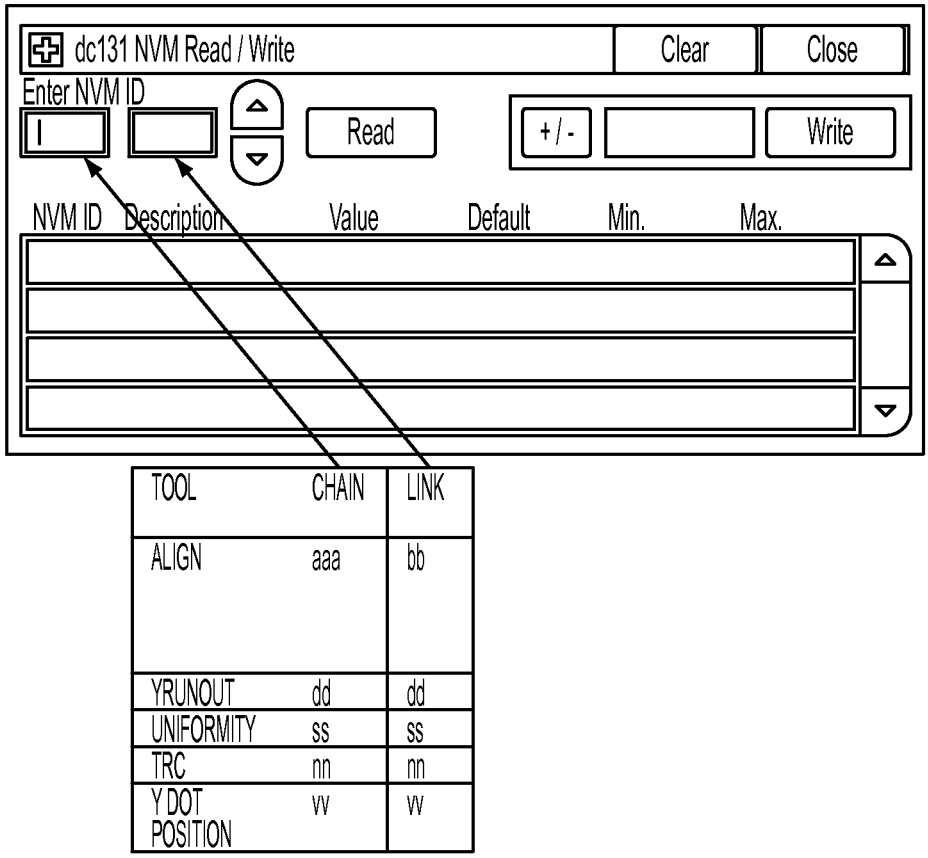
FIG. 11 is an illustration of a display generated to identify data about calibration tools in an image generating system and a table of values for the illustrated display.
Figure 12:
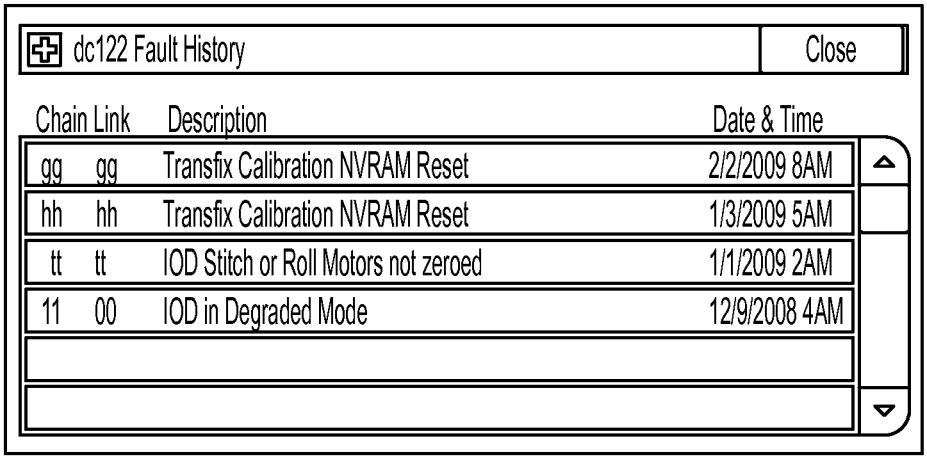
FIG. 12 is an illustration of a fault log generated by calibration tools in an image generating system.

An example of a process that may be used to evaluate the error code and tool states is shown in FIG. 10. The process 500 begins by determining that the error code or fault log indicates image quality has degraded to an unacceptable level (block 504). The tool status locations are checked according to the sequence order (block 508). The status is retrieved (block 512) to determine whether it is optimal (block 516). If it is, the next tool status is retrieved and checked. A non-optimal tool status causes the corresponding tool to be selected and used to operate the system (block 520). The tool status (block 524) and the fault log (block 528) are tested to determine whether the tool failed to return to the optimal status or correct the image quality (block 532). If the tool status upgraded to optimal and the image quality is acceptable, the next tool is selected and used to operate the system (block 536). This process continues until all the tools are optimal and the image quality is acceptable or the tool status values and the fault log identify the failing tool or tools and/or the image problem (block 540). FIG. 11 illustrates an example of a user interface and the values that may be used for status conditions for a set of calibration tools. FIG. 12 depicts an example of a fault log.

In operation, the controller of an imaging system is configured with a set of calibration tools, a sequence for selecting and operating the tools, and a schedule for selecting and operating the tools. During the life of the imaging system, the controller selects and operates the calibration tools in accordance with the schedule. Tools addressing issues arising with predictability, such as thermal conditions, or more frequent, but non-predictable issues, such as environmental conditions like dust or the like, may be executed during active periods. Other tools addressing issues arising from aging of components during the system life cycle may be executed during idle times. Of course, the more frequently executed tools may have their execution delayed until an idle time or the schedule for executing the tools may be altered as described above. The tools scheduled for selection and operation at a particular time are selected in accordance with the predetermined sequence. Additionally, the status of each tool and an error code corresponding to the tool status values are used to identify image problems and to execute the tools in an appropriate order to resolve image quality problems, if they can be resolved. Otherwise, the tool status conditions, the error code, and fault log generated during the execution of the tools enable a field service technician to identify and correct the system image problem.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A system for evaluating image quality in an image generating system comprising:

at least one image generator configured to generate an image;

an image capture device configured to generate a digital signal corresponding to a generated image;

an image evaluator configured to process the digital signal to detect and correct anomalies detected in the generated image;

a plurality of calibration tools, each calibration tool being comprised of at least one test pattern, at least one set of detection criteria, and at least one set of anomaly correction parameters; and a controller configured to select the calibration tools for operation of the at least one image generator and the image evaluator with reference to a predetermined sequence that attenuates changes arising from application of anomaly correction parameters of one calibration tool upon a later selected calibration tool, wherein the plurality of calibration tools generate and evaluate images generated with an ink ejecting device, wherein the plurality of calibration tools further comprising at least one printhead calibration tool, and wherein the at least one printhead calibration tool further comprising a missing inkjet calibration tool; a printhead-to-printhead alignment calibration tool; a printhead-to-printhead intensity calibration tool; a tonal reproduction curve (TRC) calibration tool; and a Y dot position calibration tool.

2. The system of claim 1 wherein the plurality of calibration tools generate and evaluate images generated with one of a monitor, a cell phone screen, and a digital projector.

3. The system of claim 1, the at least one printhead calibration tool configured to generate and correct an image with a single printhead further comprising:

one of a missing inkjet calibration tool and a Y dot position calibration tool.

4. The system of claim 1, the at least one printhead calibration tool further comprising:

at least one printhead calibration tool configured to generate and correct an image on an intermediate imaging member with ink ejected from at least one printhead.

5. The system of claim 4 wherein the at least one printhead calibration tool configured to generate and correct an image on an intermediate imaging member includes an imaging drum runout calibration tool.

6. The system of claim 1 wherein the controller is further configured to select the calibration tools in the predetermined sequence in accordance with a predetermined schedule.

7. The system of claim 6 wherein the controller modifies the predetermined schedule in response to a detected workload for the image generating device.

8. The system of claim 1 wherein the controller is further configured to detect at least one condition status associated with a calibration tool before selecting the calibration tool.

9. The system of claim 8 wherein the controller is further configured to assign a state to the calibration tool selected for operation of the at least one image generator and the image evaluator in accordance with at least one condition status associated with the selected calibration tool.

10. The system of claim 1, the at least one printhead calibration tool further comprising:

an imaging drum runout calibration tool.

11. The system of claim 10 wherein the predetermined sequence for the plurality of calibration tools orders the selection of the printhead-to-printhead alignment calibration tool, the imaging drum runout calibration tool, the printhead-to-printhead intensity calibration tool, the Y dot position calibration tool, and the TRC calibration tool.

12. A method for evaluating image quality in an image generating system comprising:

selecting a calibration tool from a plurality of calibration tools with reference to a predetermined sequence that attenuates changes arising from application of one calibration tool upon a later selected calibration tool;

generating at least one test pattern for the selected calibration tool with an image generating system;

generating a digital signal corresponding to the generated test pattern;

processing the digital signal to detect anomalies in the generated test pattern; and applying correction parameters associated with the selected calibration tool in response to the detection of anomalies in the generated test pattern, wherein the test pattern is generated with an ink ejecting device, wherein the selection of a calibration tool from the plurality of calibration tools further comprising selecting at least one printhead calibration tool, and wherein the at least one printhead calibration tool further comprising a missing inkjet calibration tool; a printhead-to-printhead alignment calibration tool; a printhead-to-printhead intensity calibration tool; a tonal reproduction curve (TRC) calibration tool; and a Y dot position calibration tool.

* * * * *